US011142439B2

(12) United States Patent
White et al.

(10) Patent No.: US 11,142,439 B2
(45) Date of Patent: Oct. 12, 2021

(54) SNUBBING JACK CAPABLE OF REACTING TORQUE LOADS

(71) Applicant: National Oilwell Varco, L.P., Houston, TX (US)

(72) Inventors: William Benjamin White, Kalispell, MT (US); Timothy S. Steffenhagen, Fort Worth, TX (US); Kraig W. Huse, Burleson, TX (US)

(73) Assignee: National Oilwell Varco, L.P., Houston, TX (US)

( * ) Notice: Subject to any disclaimer, the term of this patent is extended or adjusted under 35 U.S.C. 154(b) by 197 days.

(21) Appl. No.: 16/466,582

(22) PCT Filed: Dec. 5, 2017

(86) PCT No.: PCT/US2017/064743
§ 371 (c)(1),
(2) Date: Jun. 4, 2019

(87) PCT Pub. No.: WO2018/106711
PCT Pub. Date: Jun. 14, 2018

(65) Prior Publication Data

US 2019/0345014 A1 Nov. 14, 2019

Related U.S. Application Data

(60) Provisional application No. 62/430,038, filed on Dec. 5, 2016.

(51) Int. Cl.
*E21B 19/086* (2006.01)
*E21B 3/04* (2006.01)
(Continued)

(52) U.S. Cl.
CPC ..... *B66F 3/08* (2013.01); *B66F 7/14* (2013.01); *E21B 3/045* (2013.01); *E21B 19/086* (2013.01)

(58) Field of Classification Search
CPC ..... E21B 3/045; E21B 19/16; E21B 19/086
See application file for complete search history.

(56) References Cited

U.S. PATENT DOCUMENTS 6,158,516 A * 12/2000 Smith ..... E21B 3/045 166/385
7,766,080 B2 * 8/2010 Khehra ..... B66F 3/24 166/85.5

(Continued)

OTHER PUBLICATIONS

International Search Report and Written Opinion dated Feb. 5, 2018, for Application No. PCT/US2017/064743.

*Primary Examiner* — Shane Bomar
(74) *Attorney, Agent, or Firm* — Conley Rose, P.C.

(57) ABSTRACT

A snubbing jack including a jack assembly including a base plate, a traveling plate, an axis extending through the base plate and the traveling plate, and a plurality of piston-cylinder assemblies, a rotary drive including a rotary base and a hub, wherein the rotary drive is configured to rotate the hub relative to the rotary base, a clamp coupled to the rotary base and configured to grip a first tubular member, a power tongs coupled to the rotary base and configured to grip a second tubular member and to rotate the second tubular relative to the rotary base, and a torque transfer device coupled between the rotary drive and the jack assembly and configured to allow the rotary drive to move axially relative to the base plate and configured to restrict rotation of the rotary drive relative to the jack assembly.

20 Claims, 9 Drawing Sheets

(51) Int. Cl.
*B66F 3/08* (2006.01)
*B66F 7/14* (2006.01)

(56) References Cited

U.S. PATENT DOCUMENTS

| | | | | |
|---|---|---|---|---|
| 2001/0000099 | A1* | 4/2001 | Rogers | E21B 3/04 166/77.51 |
| 2003/0075023 | A1* | 4/2003 | Robichaux | E21B 19/07 81/57.37 |
| 2004/0262015 | A1* | 12/2004 | Mazzella | E21B 19/16 166/383 |
| 2006/0108122 | A1* | 5/2006 | Buytaert | E21B 19/22 166/379 |
| 2011/0030512 | A1 | 2/2011 | Begnaud, Jr. | |
| 2013/0192842 | A1 | 8/2013 | Overstreet et al. | |
| 2013/0255969 | A1 | 10/2013 | Olsen et al. | |
| 2013/0340356 | A1* | 12/2013 | Flusche | E21B 19/165 52/116 |
| 2013/0341002 | A1* | 12/2013 | Flusche | E21B 19/155 166/77.52 |
| 2013/0341041 | A1 | 12/2013 | Flusche et al. | |
| 2013/0341044 | A1* | 12/2013 | Flusche | E21B 19/15 166/381 |
| 2015/0107850 | A1 | 4/2015 | Mosing et al. | |
| 2017/0314345 | A1* | 11/2017 | Flusche | E21B 19/16 |

* cited by examiner

SNUBBING JACK CAPABLE OF REACTING TORQUE LOADS

CROSS-REFERENCE TO RELATED APPLICATIONS

This application is a 35 U.S.C. § 371 national stage application of PCT/US2017/064743 filed Dec. 5, 2017, and entitled "Snubbing Jack Capable of reacting Torque Loads" which claims benefit of U.S. provisional patent application Ser. No. 62/430,038 filed Dec. 5, 2016, and entitled "Snubbing Jack Capable of Reacting Torque Loads," both of which are hereby incorporated herein by reference in their entirety.

STATEMENT REGARDING FEDERALLY SPONSORED RESEARCH OR DEVELOPMENT

Not applicable.

BACKGROUND

Field of the Disclosure

This disclosure relates generally to making and breaking connections between tubular members over a well bore. More particularly, it relates to an apparatus and system for making and breaking connections over a wellbore while reacting against snubbing loads. Still more particularly, this disclosure relates to a snubbing jack, and methods and apparatus for reacting torque loads when tubular connections are made up and broken out.

Background to the Disclosure

A snubbing jack is an apparatus having multiple hydraulically-operated piston-cylinder assemblies configured to lift a string of tubular members from a well bore and to push the string down into the well bore, as may be necessitated by downhole fluid pressure or friction in the well bore. Alongside a conventional snubbing jack, a combined, open-faced hydraulic tong and backup clamp unit typically hangs from a davit arm in the work basket at the top of the snubbing jack. When adding a tubular member, such as joint of pipe (i.e. a piece of pipe), to a workstring of tubular members that extends into a wellbore, the workstring is held against gravity by stationary slips located underneath the snubbing jack, and the additional tubular member is positioned above the workstring by a hoist. The combined open-faced tong and backup clamp are swung over well center and around the tool joints of the workstring and the tubular member where the tong and backup clamp can "make-up" a threaded connection. ("Tool joint" refers to the threaded end of a tubular member.) The process of "breaking-out" a threaded connection to remove a tubular member from the workstring is similarly performed, in reverse to the process of making up a connection. Each operation requires manipulation of heavy machinery by an operator in a confined space that is typically shared by three human operators. In the event that the backup clamp slips on its tool joint, the combined tong and backup clamp unit will attempt to rotate around the work string since, in this condition. In some applications, the operators must react quickly to avoid harm to themselves and to avoid damaging the jack.

In a typical conventional arrangement, a rotary drive that serves to rotate the workstring in the well is mounted to the traveling plate of the snubbing jack, and traveling slips are mounted to the hub of the rotary drive. In this way, the workstring can be rotated while it is supported by the traveling slips, and it can be simultaneously moved in or out of the well bore by the jacking cylinders which support the traveling plate. The torque from the rotary drive is reacted through the jacking cylinders in this conventional arrangement. Because standard hydraulic cylinders do not have the ability to support or react against large perpendicular loads (e.g. forces resulting from the torque), conventional jacking cylinders have tended to be complicated, expensive, and require specialized design features. Even with these features, the torque of the rotary drive must be limited as the length that the cylinders extend increases.

One way to eliminate the necessity of swinging the tong and backup clamp through the work basket and on and off the workstring is to mount the tong and backup clamp unit to the snubbing jack itself. Closed-face tong and backup clamp units can then be utilized, with a further advantage that closed-face tongs and backup clamps often provide more torque for their size. Two variations of this system exist in prior art. The first is that the tong and backup clamp are mounted to the traveling plate of the jack but are positioned above the traveling slips. This arrangement has the disadvantage that its mounting structure must extend around the large rotary drive and traveling slips, extending radially outward and axially downward to reach the traveling plate located below the rotary drive. The second variation is to mount the tong and backup clamp to the top of the traveling slips. This arrangement has the disadvantage that the tong and backup clamp will then rotate when the rotary drive is engaged.

An improved snubbing jack that does not require a swinging tong and backup clamp and that effectively reacts the torque load of a rotary drive would be advantageous in the industry, as would a snubbing jack that does not transfer the tong's torque to the jacking cylinders through the traveling plate. in the event that the backup clamp slips on the workstring.

BRIEF SUMMARY OF THE DISCLOSURE

An embodiment of a snubbing jack comprises a jack assembly comprising a base plate, a traveling plate, an axis extending through the base plate and the traveling plate, and a plurality of piston-cylinder assemblies configured to move the traveling plate axially with respect to the base plate, a rotary drive comprising a rotary base and a hub, wherein the rotary drive is configured to rotate the hub relative to the rotary base, and wherein the rotary base is coupled to the traveling plate to travel axially with the traveling plate, a clamp coupled to the rotary base and configured to grip a first tubular member, a power tongs coupled to the rotary base and configured to grip a second tubular member and to rotate the second tubular relative to the rotary base, and a torque transfer device coupled between the rotary drive and the jack assembly and configured to allow the rotary drive to move axially relative to the base plate and configured to restrict rotation of the rotary drive relative to the jack assembly. In some embodiments, the rotary base is coupled to the traveling plate by a rotary coupling configured to restrict the rotary drive from moving axially relative to the traveling plate and configured to allow rotation of the rotary drive relative to the traveling plate. In some embodiments, the rotary base comprises an annular shoulder, and wherein the rotary coupling includes an attachment member coupled to the traveling plate and having a shoulder slidingly engaging the annular shoulder of the rotary base. In certain embodiments, the attachment member comprises a ring, and wherein the shoulder of the attachment member of the rotary coupling extends circumferentially around a majority of the shoulder of the rotary base. In certain embodiments, the torque transfer device comprises a lower torque member rigidly coupled to the base plate, an upper torque member disposed along the lower torque member and rigidly coupled to the rotary base, and a linearly sliding coupling configured to allow the upper torque member to move axially relative to the lower torque member and configured to restrict rotation of the upper torque member relative to the lower torque member. In some embodiments, the linearly sliding coupling comprises an axial slot disposed in the lower torque member and a pin extending from the upper torque member and slidingly received in the slot. In certain embodiments, the lower torque member and the upper torque member are concentric tubular members, the upper torque member includes a flange that is rigidly coupled to the rotary base, the rotary base comprises an annular shoulder, and the rotary coupling comprises an attachment member coupled to the traveling plate and having a shoulder slidingly engaging the annular shoulder of the rotary base, and a bearing disposed between the traveling plate and the flange of the upper torque member. In certain embodiments, the snubbing jack further comprises a mounting frame rigidly coupled to the rotary base and extending to the clamp and the power tongs, wherein the mounting frame couples the clamp and the power tongs to the rotary base for rotational and axial support, and wherein the mounting frame is configured to allow the clamp and the power tongs to move axially relative to one another while restricting the clamp and the power tongs from rotating relative to one another. In some embodiments, the clamp and the power tongs are configured to be releasably coupled to and decoupled from the rotary base independently of each other. In some embodiments, the clamp is coupled to the rotary base by a first mounting frame extending between the clamp and the rotary base, and the power tongs is coupled to the rotary base by a second mounting frame extending between the power tongs and the rotary base, and the second mounting frame is independent of the first mounting frame. In certain embodiments, the torque transfer device comprises a reaction member laterally offset from the axis, and wherein the reaction member is engaged by a roller coupled to the traveling plate. In certain embodiments, the snubbing jack further comprises a tool retrieval assembly configured to move at least one of the clamp and power tongs laterally relative to the axis.

An embodiment of a snubbing jack comprises a jack assembly comprising a base plate, a traveling plate, an axis extending through the base plate and the traveling plate, and a plurality of piston-cylinder assemblies configured to move the traveling plate axially with respect to the base plate, a rotary drive comprising a rotary base and a hub, wherein the rotary drive is configured to rotate the hub relative to the rotary base, and wherein the rotary base is coupled to the traveling plate to travel axially with the traveling plate, a clamp coupled to the rotary base and configured to grip a first tubular member, a power tongs coupled to the rotary base and configured to grip a second tubular member and to rotate the second tubular relative to the rotary base, and a tool retrieval assembly configured to move at least one of the clamp and power tongs laterally relative to the axis. In some embodiments, the snubbing jack further comprises a first tool frame extending from the rotary drive, and a second tool frame supported by the first tool frame, wherein the second tool frame is laterally moveable relative to the first tool frame. In some embodiments, the tool retrieval assembly comprises a pair of arms extending laterally from the first tool frame, and a sliding jack coupled between the first tool frame and the second tool frame, wherein the sliding jack is configured to move the second tool frame laterally along a rail of each arm to dispose the second tool frame in a laterally offset position relative to the axis. In certain embodiments, the tool retrieval assembly comprises a lifting jack coupled between the second tool frame and a slip bowl, wherein the lifting jack is configured to move the slip bowl axially relative to the first tool frame. In certain embodiments, the snubbing jack further comprises a torque transfer device coupled between the rotary drive and the jack assembly and configured to allow the rotary drive to move axially relative to the base plate and configured to restrict rotation of the rotary drive relative to the jack assembly. In some embodiments, the torque transfer device comprises a pair of I-beams and wherein each I-beam is engaged by a roller coupled to the traveling plate.

An embodiment of a method for drilling a wellbore comprises (a) rotating a tubular member with a power tong of a snubbing jack, (b) reacting rotational torque transmitted from the power tong with a torque transfer device coupled to a jack assembly of the snubbing jack, and (c) moving the tubular member axially relative to a base plate of the jack assembly during (b). In some embodiments, the method further comprises (d) actuating a lifting jack to lift a slip bowl relative to a tool frame of the snubbing jack, and (e) actuating a sliding jack to move the slip bowl laterally relative to the tool frame.

Thus, embodiments described herein include a combination of features and characteristics intended to address various shortcomings associated with certain prior devices, systems, and methods. The various features and characteristics described above, as well as others, will be readily apparent to those of ordinary skill in the art upon reading the following detailed description, and by referring to the accompanying drawings.

BRIEF DESCRIPTION OF THE DRAWINGS

For a detailed description of the disclosed exemplary embodiments, reference will now be made to the accompanying drawings, wherein.

NOTATION AND NOMENCLATURE

Figure 1:
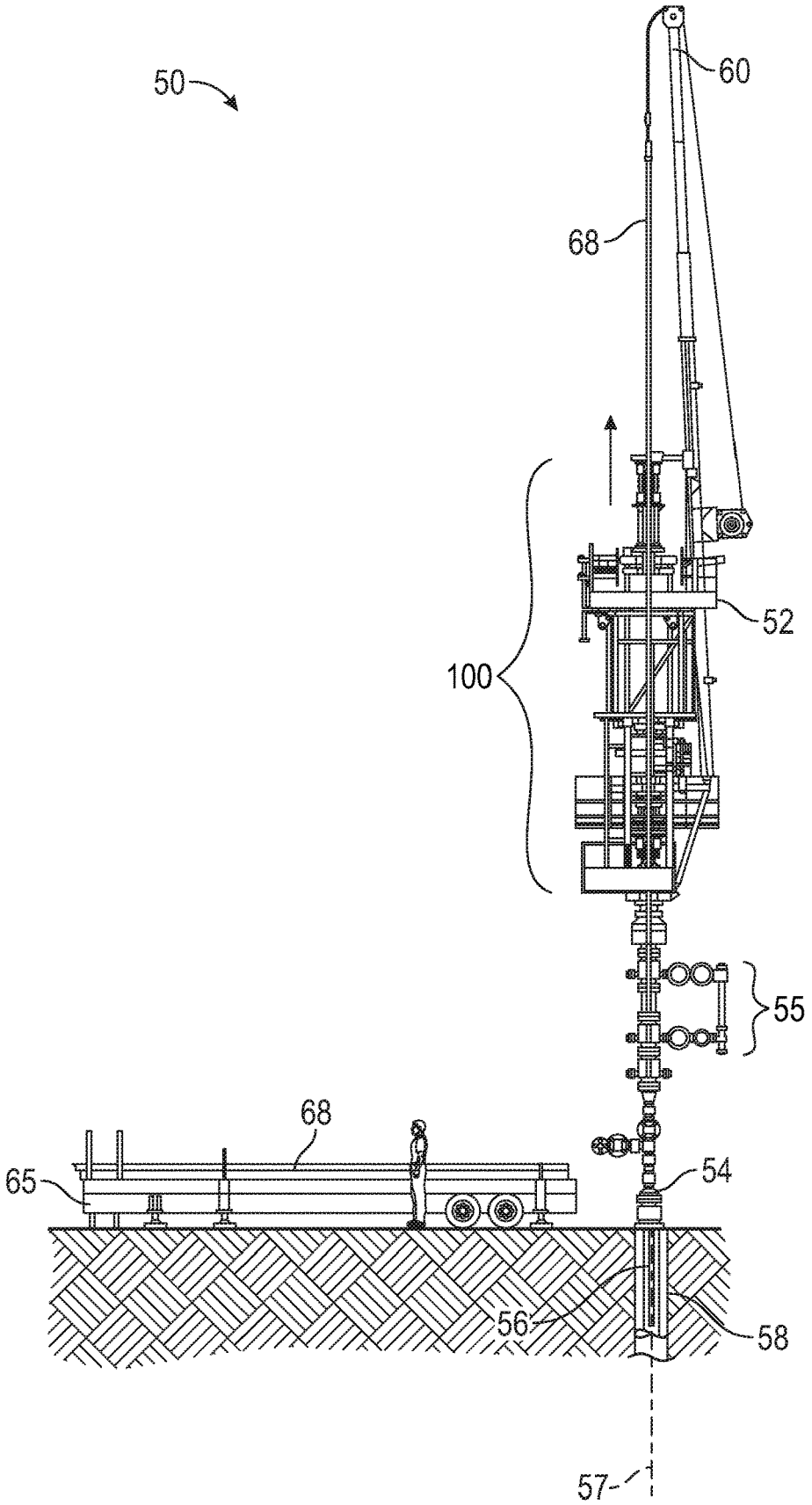
FIG. 1 shows a front view in partial cross-section of an embodiment of a well system having snubbing jack in accordance with principles described herein.

The following description is exemplary of certain embodiments of the disclosure. One of ordinary skill in the art will understand that the following description has broad application, and the discussion of any embodiment is meant to be exemplary of that embodiment, and is not intended to suggest in any way that the scope of the disclosure, including the claims, is limited to that embodiment.

The figures are not necessarily drawn to-scale. Certain features and components disclosed herein may be shown exaggerated in scale or in somewhat schematic form, and some details of conventional elements may not be shown in the interest of clarity and conciseness. In some of the figures, in order to improve clarity and conciseness, one or more components or aspects of a component may be omitted or may not have reference numerals identifying the features or components. In addition, within the specification, including the drawings, like or identical reference numerals may be used to identify common or similar elements.

As used herein, including in the claims, the terms "including" and "comprising," as well as derivations of these, are used in an open-ended fashion, and thus are to be interpreted to mean "including, but not limited to . . . ." Also, the term "couple" or "couples" means either an indirect or direct connection. Thus, if a first component couples or is coupled to a second component, the connection between the components may be through a direct engagement of the two components, or through an indirect connection that is accomplished via other intermediate components, devices and/or connections. As used herein, including in the claims, to describe a connection between two components or other items, the phrase "rigidly coupled" means that the two items are connected such that the first cannot move translationally or rotationally relative to the other. The recitation "based on" means "based at least in part on." Therefore, if X is based on Y, then X may be based on Y and on any number of other factors. The word "or" is used in an inclusive manner. For example, "A or B" means any of the following: "A" alone, "B" alone, or both "A" and In addition, the terms "axial" and "axially" generally mean along or parallel to a given axis, while the terms "radial" and "radially" generally mean perpendicular to the axis. For instance, an axial distance refers to a distance measured along or parallel to a given axis, and a radial distance means a distance measured perpendicular to the axis. Furthermore, any reference to a relative direction or relative position is made for purpose of clarity, with examples including "top," "bottom," "up," "upward," "down," "lower," "clockwise," "left," "leftward," "right," "right-hand," "down", and "lower." For example, a relative direction or a relative position of an object or feature may pertain to the orientation as shown in a figure or as described. If the object or feature were viewed from another orientation or were implemented in another orientation, it may be appropriate to describe the direction or position using an alternate term.

DETAILED DESCRIPTION OF THE DISCLOSED EXEMPLARY EMBODIMENTS

Referring to FIG. 1, in an exemplary embodiment, a well system 50 includes a platform 52, a well head 54, a blow-out preventer (BOP) 55, a workstring 56 of one or more tubular members extending through well head 54 and into a borehole or wellbore 58, a hoist 60 (sometimes referred to as a "gin pole") extending upward from platform 52, and a snubbing jack 100. Well system 50 further includes a storage rack or a trailer 65 for storing tubular members 68.

Snubbing jack 100 is mounted on well head 54 and configured to grasp and manipulate workstring 56 and tubular members received from or delivered to trailer 65 when making or breaking a threaded connection between workstring 56 and a separate tubular member 68 in order to extend or reduce the length of workstring 56. Axis 57 represents the longitudinal axis of workstring 56. Optionally, the term "combined tubular member" may be used to describe workstring 56 or any combination of two or more tubular members 68 threadingly coupled together. For convenience, each separate tubular member 68 on trailer 65 may include 1, 2, 3 or more pieces of pipe or other individual tubular members combined together.

Figure 2:
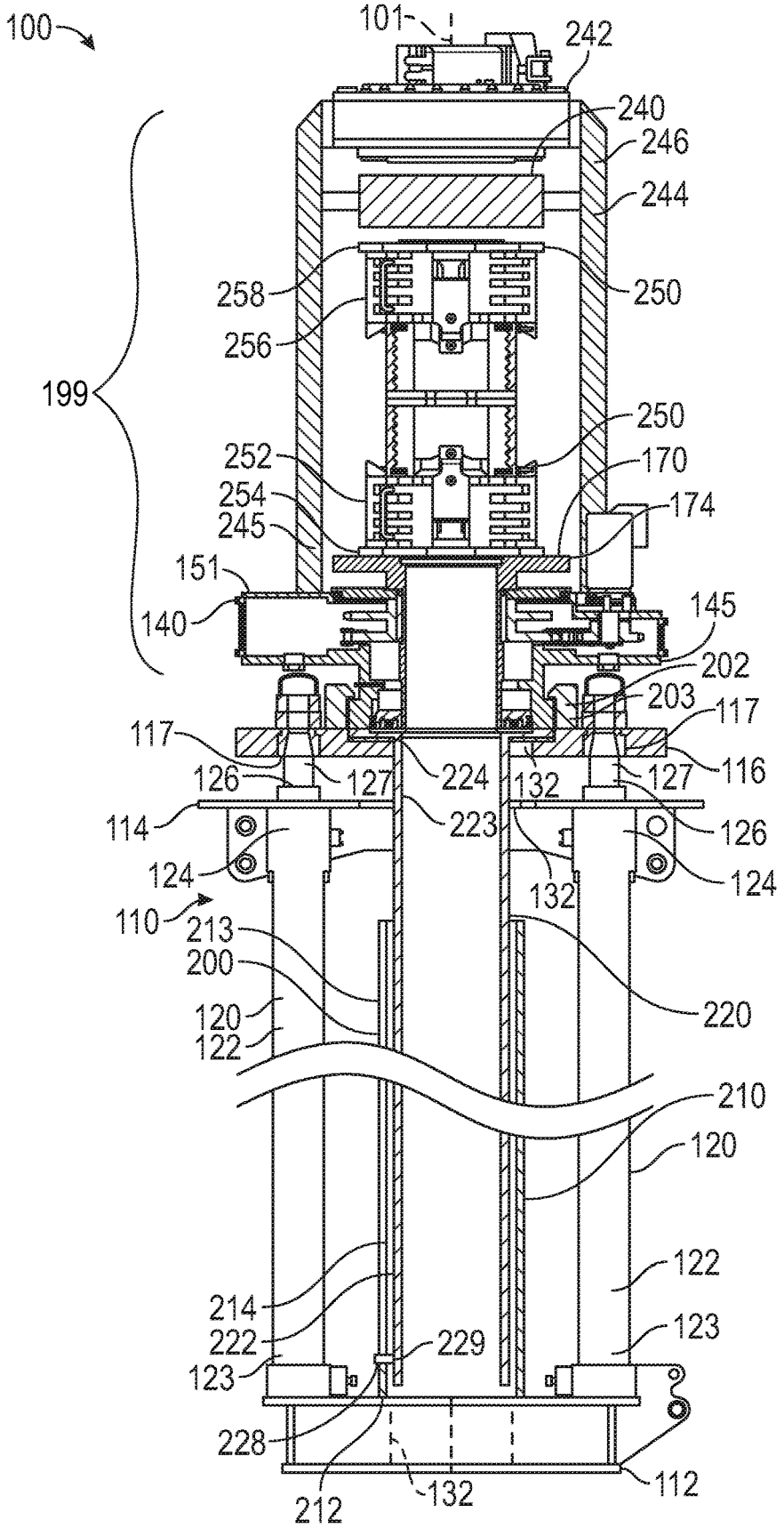
FIG. 2 shows a front view in partial cross-section of the snubbing jack of FIG. 1.

Referring now to FIG. 2, a first exemplary embodiment of snubbing jack 100 includes a longitudinal or central tool axis 101, a jack assembly 110, which may also be called a jack lower structure 110, and a tool assembly 199, which may also be called a jack upper structure 199.

Figure 3:
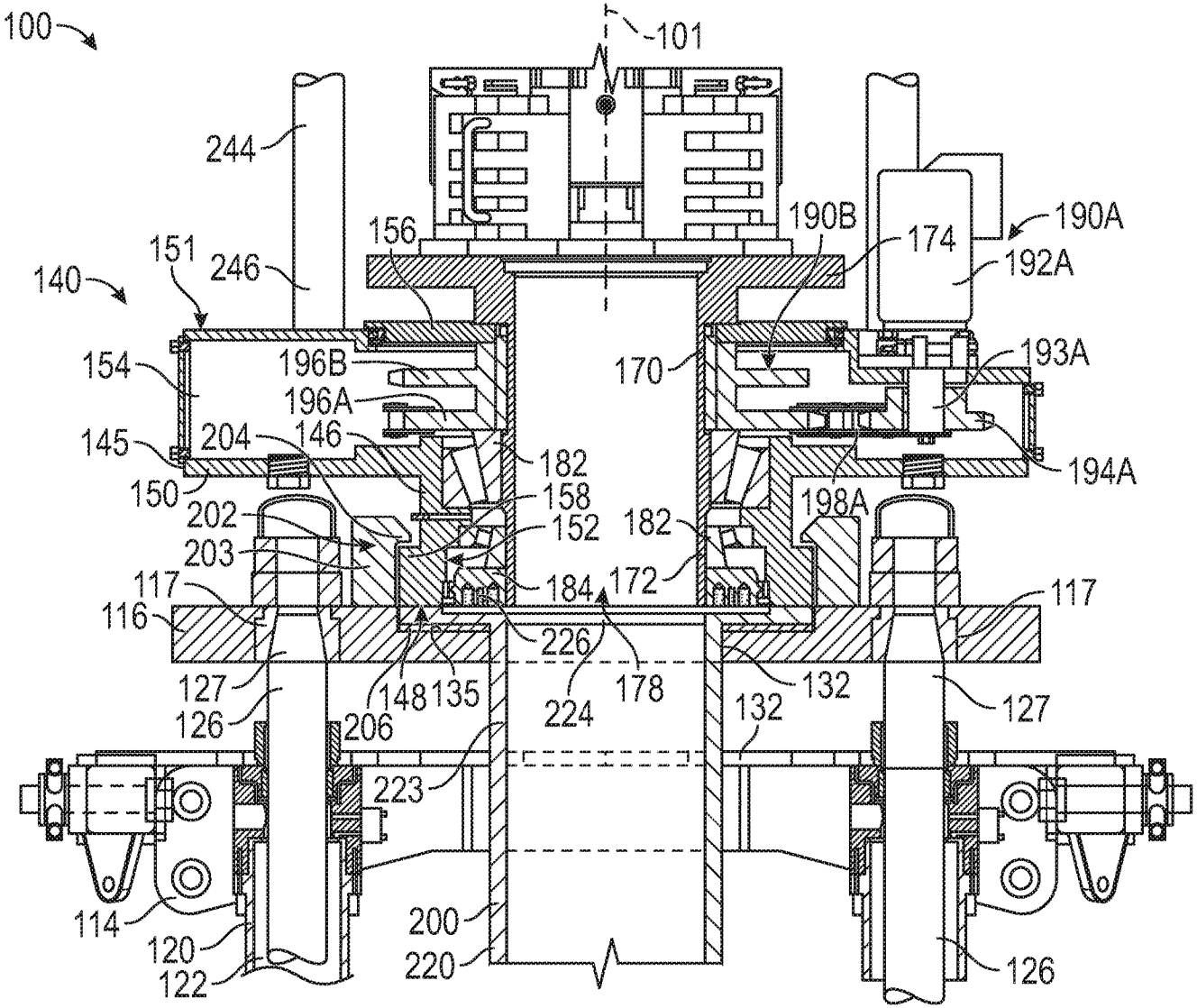
FIG. 3 shows an enlarged view in partial cross-section of the upper portion of the snubbing jack of FIG. 2.

Jack assembly 110 includes a jack base plate 112 located at the bottom, a jack top plate 114 above base plate 112 and spaced-apart along axis 101, a jack traveling or load plate 116 above top plate 114, and a plurality of hydraulic piston-cylinder assemblies or "jack cylinders" 120 coupled to plates 112, 114, 116. In the example, assembly 110 includes four jack cylinders 120. Each jack cylinder 120 includes a housing cylinder 122 extending from a base end 123 coupled at base plate 112 to an action end 124 coupled at top plate 114. Jack cylinder 120 further includes a piston and a piston extension shaft 126 slidingly received within cylinder 122 and having an outer end 127 that extends beyond the cylinder's action end 124. The coupled piston and piston extension shaft will be simply called piston 126. Piston outer end 127 extends into one of a plurality of attachment apertures 117 in traveling plate 116, being coupled to plate 116 in a configuration that allows piston 126 both to push plate 116 upward and to pull plate 116 downward with respect to base plate 112. Plate 116 is configured to support the loads that are lifted upward or pulled downward by jack cylinders 120. An aperture 132 centered on axis 101 extends through each of the three plates 112, 114, 116. The arrangement of jack assembly 110 is also shown in the enlarged views of FIG. 3 and FIG. 4. As best shown in FIG. 3, aperture 132 intersects with an enlarged recess 135 on the upper surface of traveling plate 116. Aperture 132 may have differing sizes, for example differing diameters, in one or more of the three plates. Recess 135 is enlarged as compared to aperture 132 within plate 116.

Continuing to reference FIG. 3, tool assembly 199 is mounted to traveling plate 116 to move with plate 116. Tool assembly 199 includes a rotary drive 140, a torque transfer device 200, a backup clamp 240, a power tongs 242, and one or more traveling slip bowls 250, all aligned along tool axis 101 and coupled together by a mounting frame 244. In some embodiments, backup clamp 240 comprises a slip bowls clamp of tool assembly 199.

Rotary drive 140 includes a rotary base 145, a rotary hub 170 rotationally mounted within base 145, and a drive assembly 190 configured to rotate hub 170 with respect to base 145. Rotary base 145 includes a generally cylindrical lower section 146 with a lower surface 148 mounted adjacent recess 135 on the top of plate 116 and an upper section 150 extending from a generally cylindrical section 146 to an upper surface 151. A through-bore 152 extends through base 145 from surfaces 148 to surface 151 and includes sections with different diameters. Upper section 150 is larger than lower section 146 and includes a cavity 154 surrounding and intersecting the through-bore 152. An annular end cap 156 partially covers an enlarged portion of through-bore 152 at upper surface 151. With end cap 156 installed, through-bore 152 extends through the end cap 156. An upward-facing, annular shoulder 158 extends around the exterior of lower section 146 between lower surface 148 and upper section 150.

Rotary hub 170 includes a lower, tubular section 172, an upper flange 174 extending radially from the top of section 172, and a through-bore 178 extending axially through section 172 and flange 174. Tubular section 172 is mounted within through-bore 152 of base 145 with a plurality of bearings 182 and is held axially by a removable flange 184. In the example of FIG. 3, bearings 182 include conical roller bearings configured to transfer both radial loads and axial, thrust loads.

In the example of FIG. 3, rotary drive 140 includes two drive assemblies 190, which will be numbered 190A,B. More components of the first drive assembly 190A are visible in FIG. 3, so it will be the focus of the discussion, with the understanding that the second drive assembly 190B is identical or similar. Drive assembly 190A includes a hydraulic motor 192A, a small gear sprocket 194B and a chain 198A. Motor 192A includes shaft 193A and is mounted adjacent the upper surface 152 of base 145. Smaller sprocket 194A is coupled to the shaft 193A of motor 190A for rotation with shaft 193A. A larger gear sprocket 196A is aligned with axis 101 and coupled around the hub tubular section 172 of rotary hub 170 to cause section 172 to rotate. Chain 198A is coupled to the sprockets 194A, 196A so that motor 192A can drive the rotation of hub 170. The larger sprocket 196A of the first drive assembly 190A is located axially adjacent the end cap 156 of base 145, and the larger sprocket 196B of the second assembly 190B is located axially adjacent the first sprocket 196A, distal end cap 156. The two sprockets 196A,B are rigidly coupled and form a unitary member in this embodiment.

Referring again to FIG. 2, backup clamp 240 and power tongs 242 are mounted along axis 101 above rotary drive 140 by the vertically extending frame 244. The lower end 245 of frame 244 is rigid coupled to rotary base 145 at the upper surface 151, and clamp 240 and tongs 242 are axially spaced-apart from each other at the upper end 246 of frame 244. Frame 244 couples clamp 240 and tongs 242 to rotary drive 140 for rotational and axial support, meaning the axial load of clamp 240, tongs 242, and the tubulars they support and any net torque that they exert is reacted by rotary base 145. Frame 244 is configured to allow clamp 240 or tong 242 to move axially for some distance to compensate for relative motion in the tool joint as it is threaded or unthreaded. During normal usage, backup clamp 240 grasps a tubular or tubular string (e.g. workstring 56) that extends downward, and power tongs 242 grasps a tubular or tubular string that extends upward and rotates relative to clamp 240 to make or break a tubular connection. This relative rotation is reacted through frame 244, but this reaction is potentially aided by rotary base 145, depending on the rigidity or flexibility of frame 244. If clamp 240 were to slip while holding workstring 56, then some or all of torque of tongs 242 (i.e. the "net torque" mentioned above) would be transferred by frame 244 and reacted by rotary base 145 and torque transfer device 200. In some embodiments, clamp 240 and tongs 242 are configured to be releasably coupled to and decoupled from frame 244 and, therefore, from rotary base 145, independently of each other. That is to say clamp 240 may be removed while tongs 242 remains attached and vice versa. Releasable coupling and decoupling does not include welding or other thermally-created joints.

Traveling slip bowls 250 are clamping devices. They are aligned along axis 101 and are located between rotary drive 140 and backup clamp 240. Slip bowls 250 include a set of lower slips 252 extending axially from a lower end 254 and a set of upper slips 256 extending from lower slips 252 to an upper end 258. The lower end 254 is coupled at the upper flange 174 of rotary hub 170 configuring slip bowls 250 to rotate and travel with hub 170. Lower slips 252 are configured to exert a radial and axial force in a first axial direction (either up or else down), and the upper slips 256 are configured to exert a radial and axial force in a second axial direction, opposite the first axial direction. The backup clamp 240, power tongs 242, frame 244, and slip bowls 250 are directly or indirectly attached to rotary drive 140 as previously described.

During various modes of operation, slip bowls 250 grasp a tubular or, commonly, a tubular string that extends downward through device 100 and allows traveling plate 116 and jack cylinders 120 to lift the tubular string upward or to depress it downward. The grasping of slip bowls 250 also allow hub 170 of drive 140 to rotate the tubular string about axis 101, being reacted by rotary base 145.

Again referencing FIG. 3, rotary drive 140 is coupled adjacent the upper surface of traveling plate 116 by a rotary coupling 202. Coupling 202 includes a thrust bearing 206 located in recess 135 and at least one attachment member 203 having a downward-facing shoulder 204 engaging the upward-facing shoulder 158 of rotary base 145. In this example, attachment member 203 is a ring that extends circumferentially around recess 135 and shoulder 158. Ring 203 may be formed as a single piece or may be formed in two or more pieces for ease of installation. Coupling 202 retains rotary drive 140—and all of tool assembly 199—in a generally fixed axial position with respect to plate 116 while allowing rotation. Coupling 202 is configured to transmit axial force both up and down from jack assembly 110 to tool assembly 199, and, optionally, to a string of tubulars 56 that are coupled to tool assembly 199. Coupling 202 is also configured to maintain the horizontal position of rotary base 145 relative to traveling plate 116. Traveling plate 116 and bearing 206 support the tool assembly 199 and, optionally, a string of tubulars 56 when the tubulars are grasps by jack assembly 110. Coupling 202 allows drive 140 to rotate, at least through acute angles, with respect to traveling plate 116 so that jack assembly 110 and its jack cylinders 120 are isolated from the torque of tool assembly 199. Bearing 206 is a thrust bearing, and is a plain bearing in this example. Any bearing or bearings configured to handle an axial load may be used.

Referring to FIG. 2, torque transfer device 200 is mounted between the lower portion of jack assembly 110 and traveling plate 116 or tool assembly 199 to transfer torque therebetween. More specifically, in this embodiment, torque transfer device 200 is mounted between the bottom plate 112 and rotary drive 140. Torque transfer device 200 includes a lower torque member 210 coupled to base plate 112 to remain with it and for torque transfer. Torque transfer device 200 also includes an upper torque member 220, slidingly coupled to torque member 210 and extending beyond member 210, being coupled to travel with traveling plate 116 or tool assembly 199. In this embodiment, lower torque member 210 is tubular and may also be called a lower torque tube 210, and upper torque member 220 is tubular and may also be called an upper torque tube 220. Torque tube 220 is received within lower torque tube 210 and extends vertically beyond tube 210. In some embodiments, the radial positions of upper and lower torque tubes 210, 220 are reversed. Although in this embodiment torque transfer device comprises two torque tubes 210, 220, in other embodiments, torque transfer device 200 may comprise different numbers of torque tubes. Additionally, in other embodiments, torque tube 210 may be coupled to a component of jack assembly 110 other than base plate 112, such as top plate 114.

Lower torque tube 210 is centered on axis 101 and extends axially from a lower end 212 rigidly coupled at base plate 112 to an upper end 213 located proximal the lower surface of top plate 114. An axial slot 214 starts within torque tube 210 adjacent lower end 212 and extends axially through upper end 213. Upper torque tube 220 is centered on axis 101 and extends axially from a lower end 222 within torque tube 220, through plates 114, 116, to an upper end 223 that includes a flange 224, which is rigidly coupled to the lower surface 148 of rotary base 145 so that tube 220 and base 145 rotate together and transfer torque. As best shown in FIG. 3, flange 224 is received in recess 135 of traveling plate 116 and rests over thrust bearing 206, providing upward, axial support for torque tube 220. Flange 224 and torque tube 220 may rotate relative to plate 116, aided by bearing 206.

As best shown in FIG. 2, a linearly sliding coupling 228 couples the upper torque tube 220 to the lower torque tube 210, allowing relative axially movement but restricting or limiting relative rotation of tubes 220, 210. In this embodiment, sliding coupling 228 includes a pin 229 attached to the lower end 222 of upper torque tube 220 and slot 214 in lower torque tube 210, which slidingly receives the end of pin 229 there through. Coupling 228 configures torque tube 220 to telescope relative to tube 210, that is say: to slide axially from and into tube 210, such that torque transfer device 200 extends and retracts. Coupling 228 further configures torque tube 210 to support or to react the rotational loads from torque tube 220, transferring rotational loads to base plate 112 but not to support or to react axial loads within the extent of slot 214. Stated more broadly, coupling 228 configures torque transfer torque transfer device 200 to support or react rotational loads from tool assembly 199 while allowing tool assembly 199 to move axially relative to base plate 112.

As described, torque transfer device 200 limits the rotation of tool assembly 199 about axis 101. Even so, the combination of torque transfer device 200, coupling 202, and bearing 206 is configured to allow tool assembly 199 to rotate, at least through acute angles, with respect to base plate 116, isolating jack cylinders 120 from the torque of tool assembly 199. Thus, torque transfer device 200 supports or reacts not only the torque of rotary drive 140 but also torque from backup clamp 240 and power tongs 242, when such torque is exerted in various operational situations. Torque tubes 210, 220 may also double as a guide tube to support workstring 56 against potential buckling when in compression.

Figure 4:
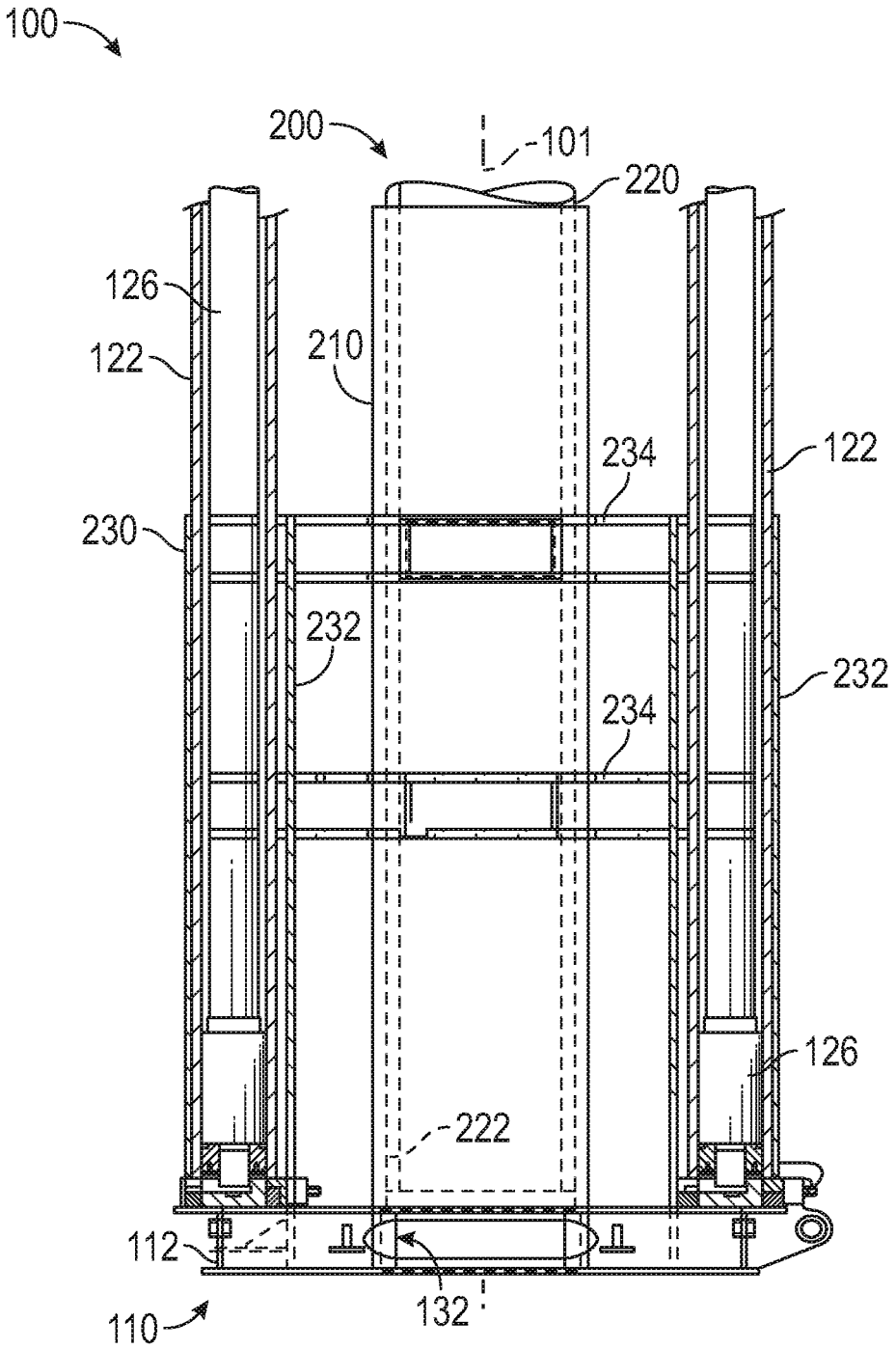
FIG. 4 shows an enlarged view in partial cross-section of the lower portion of the snubbing jack of FIG. 2.
Figure 5:
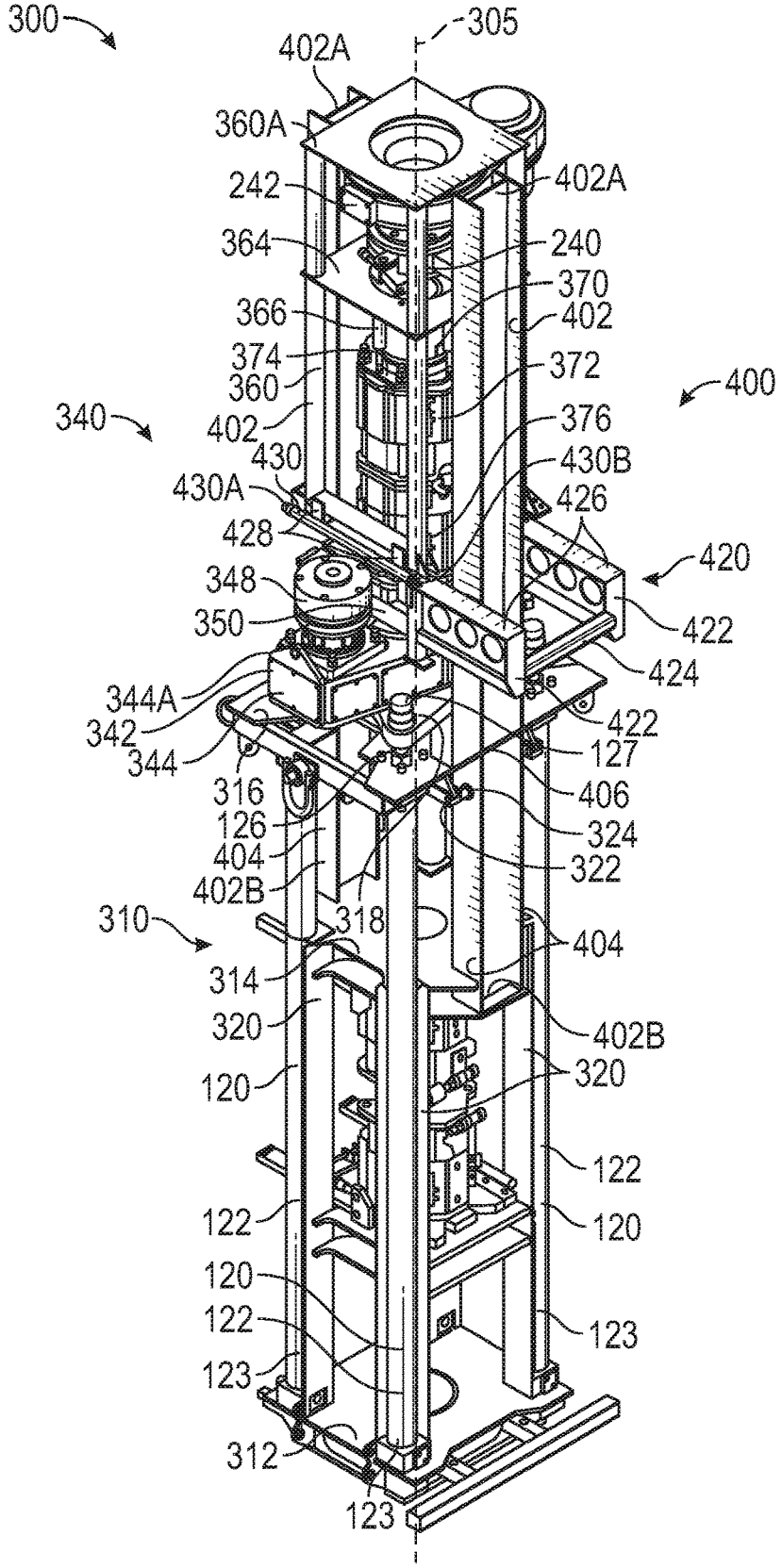
FIG. 5 shows an isometric view of another embodiment of a snubbing jack in accordance with principles described herein.
Figure 6:
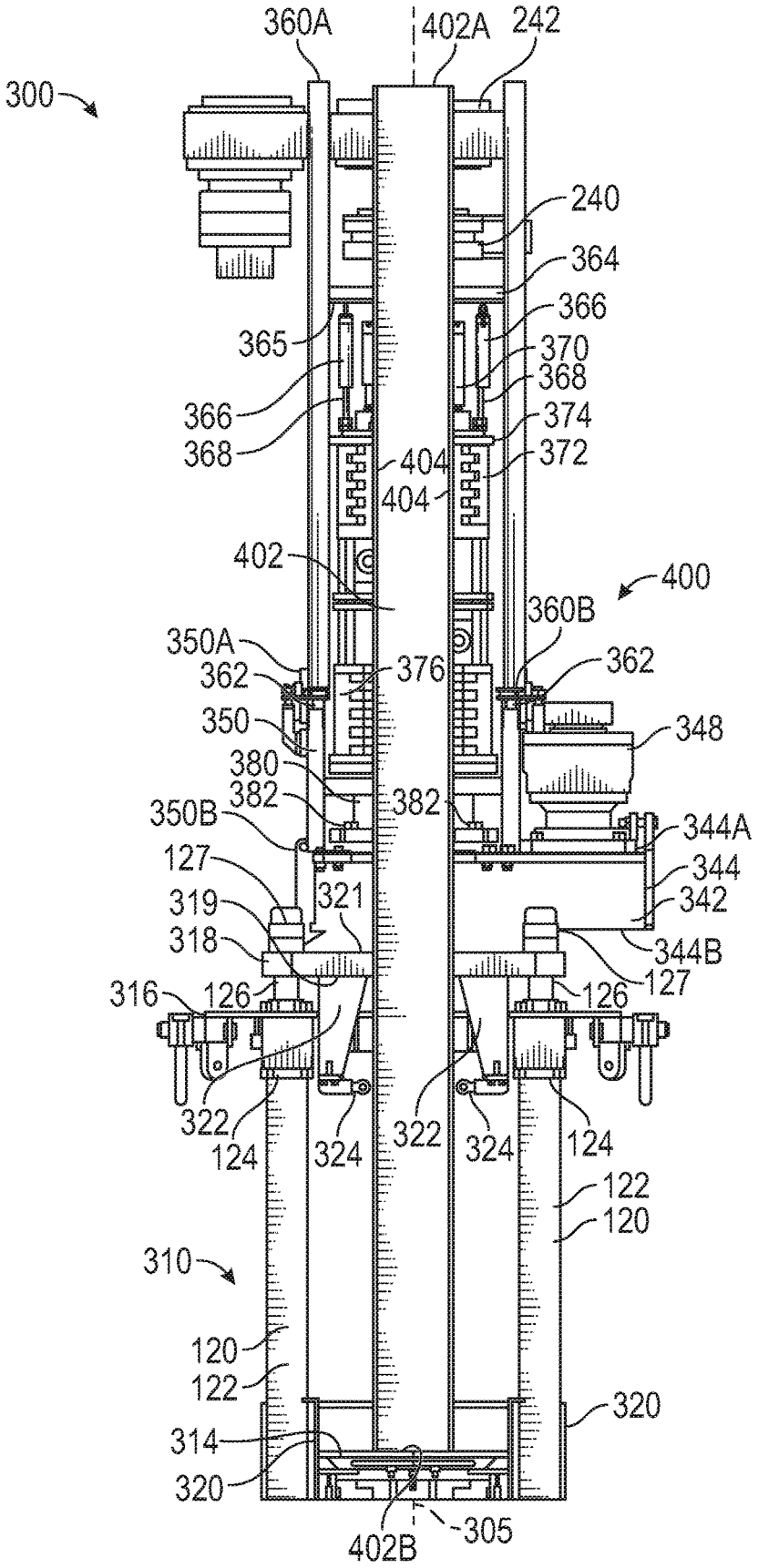
FIG. 6 shows a side view of the snubbing jack of FIG. 5.
Figure 7:
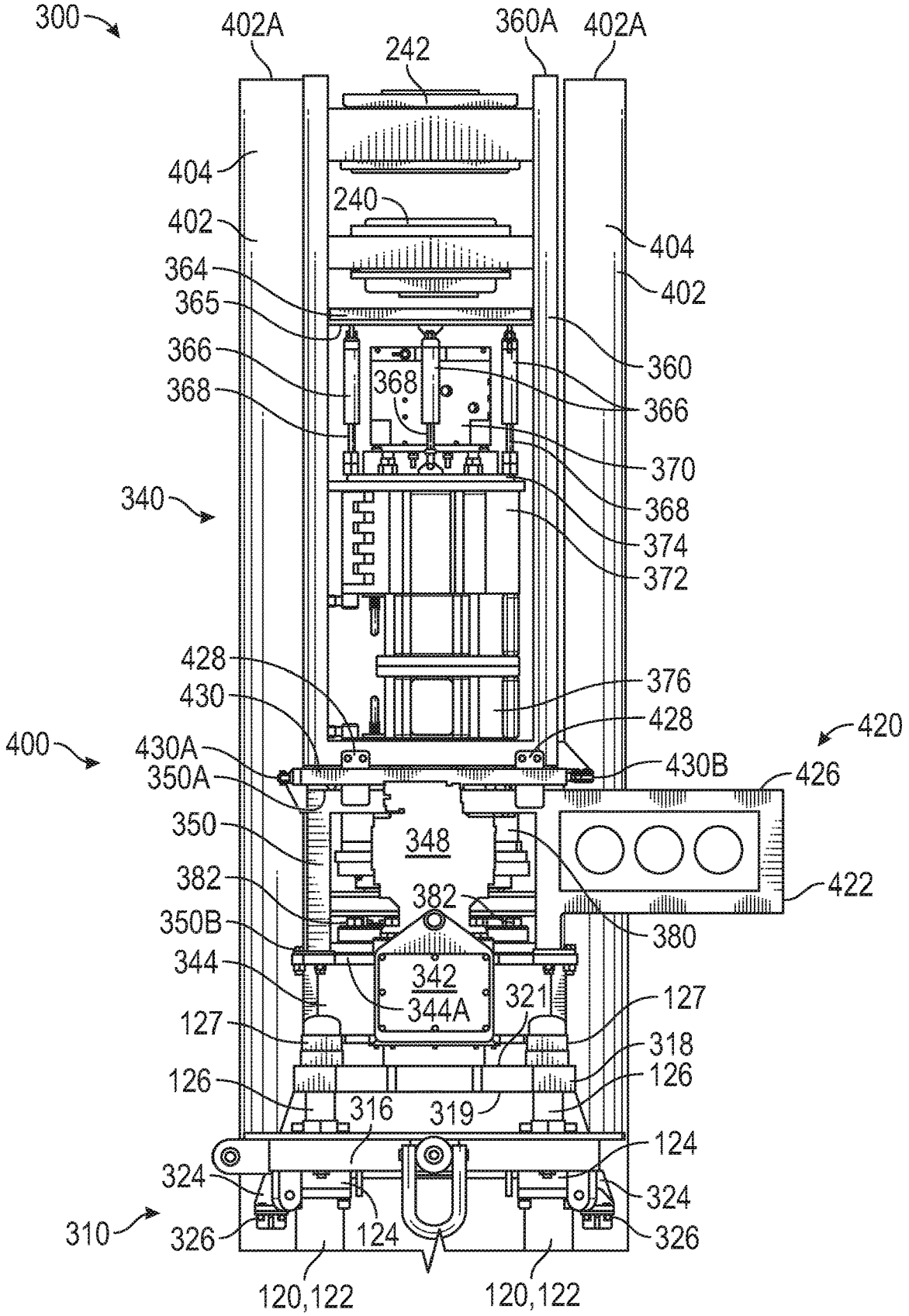
FIG. 7 shows a zoomed-in side view of an embodiment of a tool assembly of the snubbing jack of FIG. 5 in accordance with principles disclosed herein.

Referring to FIG. 4, a support apparatus 230 includes a plurality of elongate legs 232 coupled to and extending upward from base plate 112. In some embodiments, legs 232 comprise an angle iron structure. Legs 232 are interconnected by one or more cross members or braces 234. In the embodiment shown, apparatus 230 has four legs 232, each leg 232 surrounding a portion of one of the jack cylinders 120. A first brace 234 is located at upper ends of legs 232, and a second brace 234 is located at approximately the mid-region of legs 232 or somewhat higher. Braces 234 are coupled to the lower torque tube 210 to provide lateral and rotational support to tube 210. The coupling of torque tube 210 to base plate 112, separate from apparatus 230, introduced earlier, also provides lateral and rotational support for torque transfer device 200. Apparatus 230 may be considered to be a part of torque transfer device 200.

Typical piston-cylinder assemblies, like jack cylinders 120, have less resistance to torsional loads as they extend to greater lengths. However, in jack 100 the inclusion of torque transfer device 200 aided, at least in some embodiments, by support apparatus 230 overcomes or reduces the torsional strength limitation of jack cylinders 120. Therefore, various embodiments of jack assembly 100, rotary drive 140 may operate even while jack cylinders 120 are partially extended, or jack cylinders 120 are fully extended because torque transfer device 200 reacts the torque of drive 140 and isolates jack cylinders 120 from that torque.

Although rotary drive 140 of FIG. 3 is shown to include two drive assemblies 190, some embodiments need only employ a single drive assembly 190 with a larger capacity motor to replace motors 192A,B. Likewise, within practical limits, rotary drive 140 may include any number of drive assemblies. Further, although ring 203 of coupling 202 was described as an annular member, in some embodiments, ring 203 may have another form, such as a group of blocks, circumferentially-spaced around recess 135 and individually mounted to plate 116. The function of coupling 202 and bearing 206 may be combined into one device such as a slewing ring or turnable bearing.

Although backup clamp 240 and power tongs 242 are mounted to a common mounting frame 244 in FIG. 2, in some embodiments, clamp 240 and tongs 242 are separately mounted to rotary base 145 by different, independent mounting frames. In some embodiments the different mounting frames are spaced apart from each other. Being mounted on different mounting frames, clamp 240 and power tongs 242 are configured to be releasably coupled to and decoupled from the rotary base 145 independently of each other. In such embodiments, rotary base 145 reacts all the torque that is exchanged between power tongs 242 and clamp 240 during normal operation. Whether one or multiple mounting frames is included, in some embodiments, clamp 240 and tongs 242 are coupled to a frame 244 or rotary base 145 by welding or by another thermally-created joint.

In FIG. 2, sliding coupling 228 was shown as a pin 229 received in a through-slot 214. It should be understood that coupling 228 may include multiple pins 229 in multiple slots 214, and some embodiments may include an axial slot that does not extend radially entirely through lower torque tube 210. In some embodiments, another form of linearly sliding coupling may be used, replacing pin 229 and slot 214 entirely, the sliding coupling allowing the lower and upper torque tubes 210, 220 to slide linearly relative to one another while restricting or limiting relative rotation of torque tubes 210, 220 so that the sliding coupling transmits torque but not an axial load. In some embodiments, lower torque tube 210 is instead received within upper torque tube 220 with coupling 228 properly rearranged. In this manner, torque transfer device 200 is configured to restrict relative rotation between rotary drive 140 and jack assembly 110.

Referring again to FIG. 4, in some embodiments, support apparatus 230 lacks legs 232, and braces 234 are attached directly to housing cylinders 112. Some embodiments of jack 100 lack a support apparatus 230 and rely entirely on the coupling of torque tube 210 to base plate 112 to provide lateral and rotational support for torque transfer device 200. In some other embodiments, torque tube 210 is not coupled to base plate 112 except through the support apparatus 230, which then provides all the lateral and rotational support for torque transfer device 200.

Referring to FIGS. 5-9, another embodiment of a snubbing jack 300 for use in the well system 50 of FIG. 1 is shown in FIGS. 5-9. Snubbing jack 300 includes features in common with the snubbing jack 100 shown in FIGS. 2-4, and shared features are labeled similarly. Similar to snubbing jack 100, snubbing jack 300 may be mounted on well head 54 of well system 50 and configured to grasp and manipulate workstring 56 and tubular members received from or delivered to trailer 65 when making or breaking a threaded connection between workstring 56 and a separate tubular member 68 in order to extend or reduce the length of workstring 56. In the embodiment of FIGS. 5-9, snubbing jack 300 has a central or longitudinal axis 305 and generally includes a jack assembly 310, a tool assembly 340, a torque transfer device 400, and a tool horizontal movement or retrieval assembly 420.

In this embodiment, jack assembly 310 of snubbing jack 300 includes a jack base plate 312 located at a lower end of jack assembly 310, a jack mid plate 314 axially spaced from base plate 312, a jack top plate 316 axially spaced from mid plate 314, a jack traveling plate 318 positioned at an upper end of the jack assembly 310, and a plurality of jack cylinders 120 spaced about central axis 305 of snubbing jack 300. The base end 123 of each jack cylinder 120 is coupled to base plate 312 while the action end 124 of each jack cylinder 120 is coupled to top plate 316 of jack assembly 310. The outer end 127 of each piston 126 is coupled to traveling plate 318 of jack assembly 310. In this configuration, traveling plate 318 may be moved axially relative to top plate 316 by actuating jack cylinders 120 to extend and retract pistons 126 relative to their respective housing cylinders 122.

In this embodiment, jack assembly 310 also includes a plurality of elongate jack support members 320 extending axially between bottom plate 312 and mid plate 31 that assist in supporting jack cylinders 120. A lower end of each support member 320 couples to the base end 123 of a corresponding jack cylinder 120 at bottom plate 312. Additionally, an upper end of each support member 320 couples to a corresponding cylinder housing 122 at mid plate 314. In this embodiment, base plate 312 of jack assembly 310 physically supports the components of tool assembly 340. Particularly, at least a portion of the weight of tool assembly 340 is transferred to base plate 312 via traveling plate 318 and jack cylinders 120 of jack assembly 310. In this embodiment, jack assembly 310 also includes a plurality of jack legs 322 that extend at an angle (e.g., axially along and radially away from central axis 305) from a lower surface of traveling plate 318. Particularly, two pairs of jack legs 322 are positioned proximal opposing or lateral ends of traveling plate 318. Additionally, a guide member or roller 324 is coupled to a terminal end of each jack leg 322. As will be described further herein, jack legs 322 interface with torque transfer device 400 to react torque from tool assembly 340.

Similar to the tool assembly 199 shown in FIGS. 2-4, tool assembly 340 of snubbing jack 300 includes tools for manipulating workstring 56 and tubular members received from or delivered to trailer 65 when making or breaking a threaded connection between workstring 56 and a separate tubular member 68. In this embodiment, tool assembly 340 generally includes backup clamp 240, power tongs 242, a rotary drive 342, a lower tool frame 350, an upper tool frame 360, a swivel 370, an upper or light slip bowl 372, a lower or heavy slip bowl 376, and a load cell 380. Rotary drive 342 is similar in functionality as the rotary drive 140 shown in FIGS. 2-4 and is configured to rotate a tubular string (e.g., workstring 56) about central axis 305 of snubbing jack 300. In this embodiment, rotary drive 342 generally includes a drive housing 344 disposed about central axis 305 and a hydraulic motor 348 offset from axis 305. Rotary housing 344 has a first or upper end 344A and a second or lower end 344B axially spaced from upper end 344A. The lower end 344B of rotary housing 344 is supported by an upper surface 321 of the traveling plate 318 of jack assembly 310.

Lower tool frame 350 of tool assembly 340 is disposed about central axis 305 and physically supports upper tool frame 360. In this embodiment, lower tool frame 305 comprises a plurality of coupled elongate members (e.g., tubular members) and has a first or upper end 350A coupled to upper tool frame 360 and a second or lower end 350B axially spaced from upper end 350A that is coupled to the upper end 344A of the rotary housing 344 of rotary drive 342. Although not shown in FIGS. 5-9, rotary drive 342 comprises a rotary hub rotatable relative to a rotary base of rotary drive 342. As will be described further herein, upper tool frame 360 of tool assembly 340 is laterally moveable relative to lower tool frame 350 to facilitate the installation and/or removal of components (e.g., backup clamp 240, power tongs 242, slip bowls 372, 376, etc.) from snubbing jack 300. In this embodiment, an upper end of light slip bowl 372 is coupled to a lower end of swivel 370 while a lower end of light slip bowl 372 is coupled to an upper end of heavy slip bowl 376. Additionally, an upper end of load cell 380 is coupled to a lower end of heavy slip bowl 376 while a lower end of load cell 380 is coupled to the upper end 344A of rotary housing 344 via a plurality of removable fasteners 382. In this configuration, the weight of swivel 370, slip bowls 372, 376, and load cell 380 is supported by rotary housing 344, which is, in-turn, supported by the upper surface 321 of traveling plate 318 of jack assembly 310.

Upper tool frame 360 is disposed about central axis 305 and comprises a plurality of coupled elongate members (e.g., tubular members). In this embodiment, upper tool frame 360 has a first or upper end 360A located at an upper end of snubbing jack 300 and a second or lower end 360B axially spaced from upper end 360A. A plurality of guide members or rollers 362 are coupled to the lower end 360B of upper tool frame 360 to permit relative horizontal or lateral movement between upper tool frame 360 and lower tool frame 350. Additionally, in this embodiment, upper tool frame 360 includes a support plate 364 axially positioned between backup clamp 240 and swivel 370, support plate 364 having a central bore or aperture for permitting the passage of tubular members (e.g., workstring 56) therethrough. A plurality of lifting actuators or jacks 366 are circumferentially spaced about central axis 305 and suspended from a lower surface 365 of support plate 364. Each lifting jack 366 includes a piston extension shaft or piston 368 extending axially downwards, away from support plate 364. In this embodiment, the upper end of light slip bowl 372 is coupled to an annular lift plate 374. Particularly, a terminal end of the piston 368 of each lifting jack 366 is coupled to lift plate 374. In this configuration, retraction of the pistons 368 of lifting jacks 366 provides an axially upwards directed or lifting force against swivel 370, slip bowls 372, 376, and load cell 380.

Similar to the functionality provided by the torque transfer device 200 shown in FIGS. 2-4, the torque transfer device 400 of snubbing jack 300 is provided to support or react rotational torque transmitted from backup clamp 240, power tongs 242, and/or rotary drive 342, transferring the rotational loads to base plate 312 while permitting relative axial movement between tool assembly 340 and base plate 312. In this embodiment, torque transfer device 200 comprises a pair of laterally spaced, axially extending reaction members or I-beams 402 laterally or horizontally offset from central axis 305. Each I-beam 402 has a first or upper end 402A, an axially spaced second or lower end 402B, and a pair of lateral ends or sides 404 extending axially between ends 402A, 402B. I-beams 402 are positioned at the lateral or horizontal sides of snubbing jack 300, with the lower end 402B of each I-beam being coupled (e.g., welded, etc.) to mid plate 314. For additional support, top plate 316 includes a pair of attachment members or brackets 404 coupled (e.g., welded, etc.) to I-beams 402.

Rotational torque is transmitted from traveling plate 318 to I-beams 402 of torque transfer device 400 via contact between rollers 324 of traveling plate 318 and the sides 404 of I-beams 402. Additionally, when jack cylinders 120 of jack assembly 310 are actuated to extend or retract traveling plate 318 relative to base plate 312, rollers 324 roll along sides 404 to permit relative axial movement between traveling plate 318 and I-beams 402 while also permitting torque to be reacted against I-beams 402. In this manner, torque transfer device 400 is configured to restrict relative rotation between rotary drive 342 and jack assembly 310. Although in this embodiment torque transfer device 400 comprises a pair of laterally spaced I-beams 402, in other embodiments, a different number of I-beams 402 or other elongate members may be provided to interface with rollers 324. For instance, in another embodiment, torque transfer device 400 comprises four I-beams 402 extending from the corners of mid plate 314.

Tool retrieval assembly 420 of snubbing jack 300 allows components of tool assembly 340 to be displaced horizontally or laterally relative to central axis 305 to conveniently remove said components from or install said components in snubbing jack 300 (e.g., due to component failure, etc.) without needing to use an external crane or hoist mechanism. In this embodiment, tool retrieval assembly 420 comprises a pair of arms 422 extending laterally or horizontally outwards from lower tool frame 350, and a pair of sliding actuators or jacks 430 coupled between lower tool frame 350 and upper tool frame 360. Particularly, each sliding jack 430 has a first end 430A coupled to the upper end of lower tool frame 350 and a second end 430B coupled to a lower end of upper tool frame 360. In this configuration, extension or retraction of the second end 430B of each sliding jack 430 relative to its first end 430A applies a horizontally or laterally directed force against upper tool frame 360.

In this embodiment, a support member or cross-brace 422 extends between terminal ends of arms 422 to provide physical support thereto. Additionally, in this embodiment, an upper end of each arm 422 comprises or forms a rail 426 along which rollers 362 of upper tool frame 360 are permitted to contact or roll. Tool retrieval assembly 420 also includes a plurality of laterally spaced support members or stabilizers 428 coupled to the lower end of upper tool frame 360. A pair of stabilizers 428 are coupled to opposing sides of upper tool frame 360. Particularly, each stabilizer extends axially downwards over the upper end of lower support frame 350 or arms 422 (depending on the relative lateral position between upper tool frame 360 and lower tool frame 350) to prevent upper tool frame 360 from leaning relative to lower tool frame 350. In other words, stabilizers 428 maintain a central or longitudinal axis of upper tool frame 360 parallel with central axis 306 of snubbing jack 300.

Figure 8:
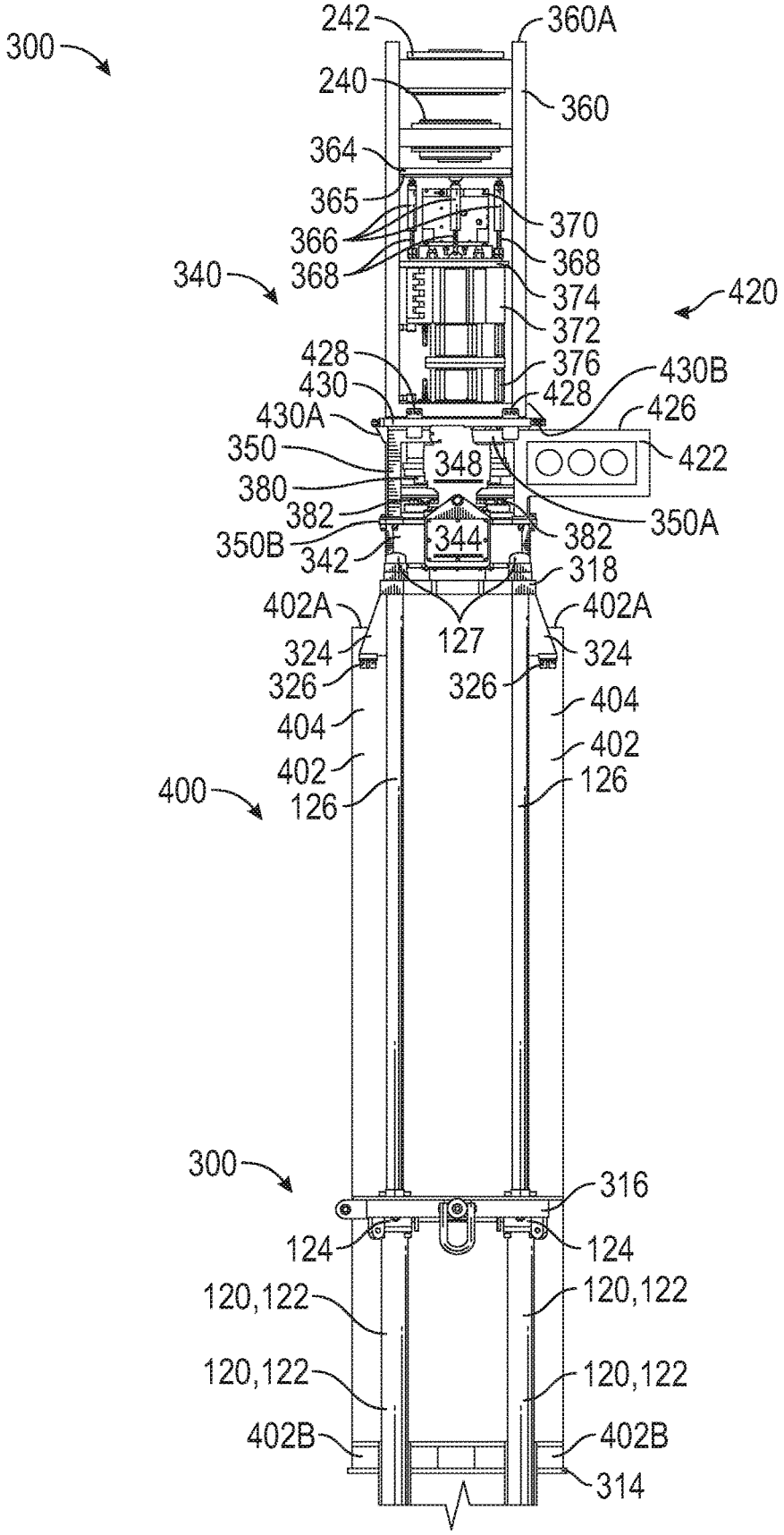
FIG. 8 shows a side view of an embodiment of a jack assembly of the snubbing jack of FIG. 5 in accordance with principles disclosed herein.
Figure 9:
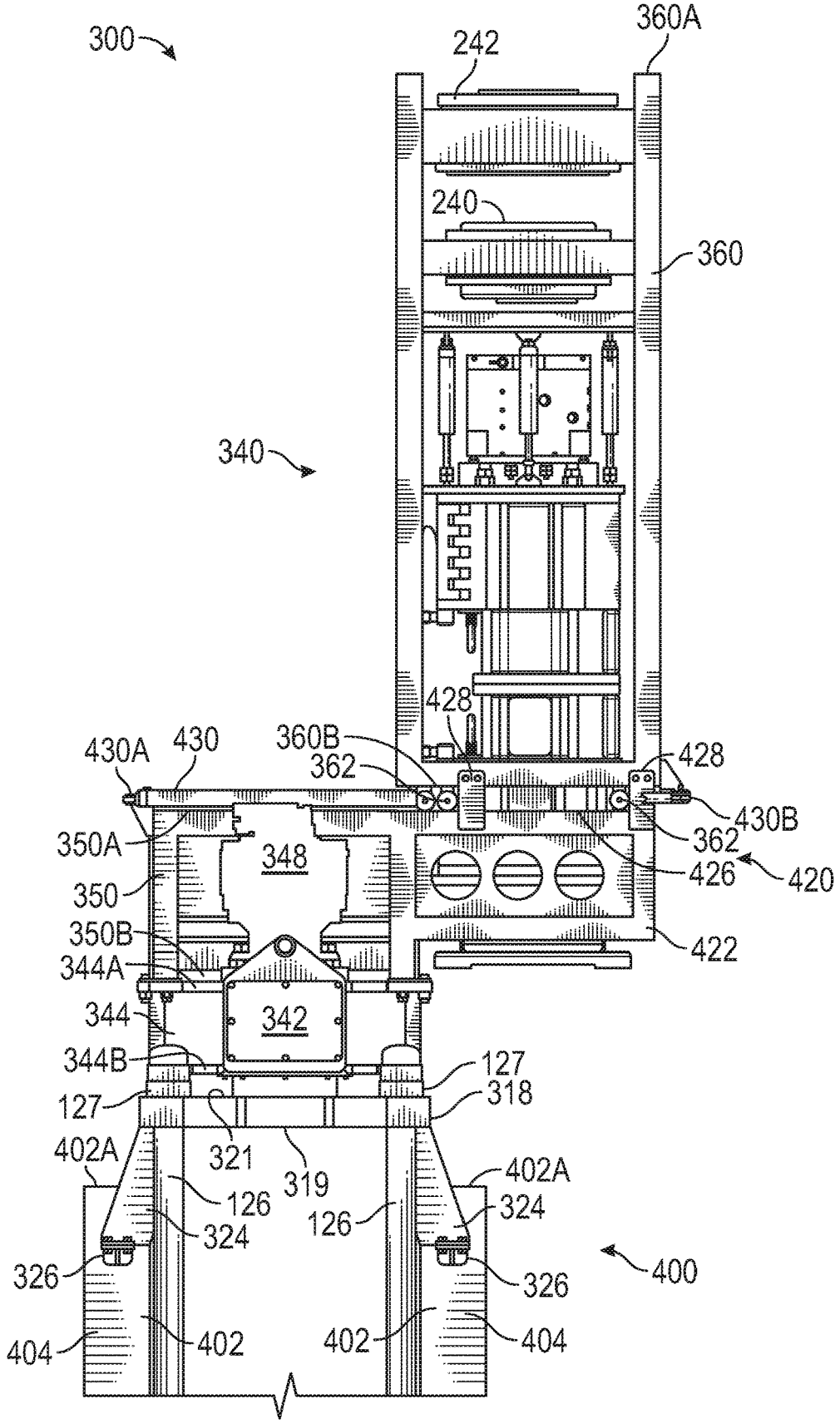
FIG. 9 shows a zoomed-in side view of an embodiment of a tool retrieval system of the snubbing jack of FIG. 5 in accordance with principles disclosed herein.

Referring particularly to FIGS. 8, 9, components of the tool assembly 340 of snubbing jack 300 are shown being removed or uninstalled therefrom in FIGS. 8, 9. Specifically, to remove components of tool assembly 340 from snubbing jack 300, the pistons 126 of jack cylinders 120 are actuated into an extended position such that arms 422 of tool retrieval assembly 420 are positioned axially above the upper end 402A of each I-beam 402 (rollers 326 remaining in contact with the sides 404 of I-beams 402), as shown particularly in FIG. 8. Once pistons 126 have been extended, providing clearance between arms 422 and I-beams 402, fasteners 382 are removed or released to uncouple load cell 380 from the rotary housing 344 of rotary drive 342, thereby permitting relative axial movement between load cell 380 (as well as swivel 370, and slip bowls 372, 376) and rotary drive 342. With load cell 380 uncoupled from rotary drive 342, the lower end of each lifting jack 366 suspended from support plate 364 is retracted to axially displace swivel 370, slip bowls 372, 376, and load cell 380 vertically upwards relative to rotary drive 342.

Once lifting jacks 366 have been actuated into a retracted position, the components of tool assembly 340 suspended from lifting jacks 366 (e.g., swivel 370, slip bowls 372, 376, and load cell 380) are permitted to move horizontally or laterally relative to rotary drive 342 and lower tool frame 350. Thus, with lifting jacks 366 actuated into the retracted position, sliding jacks 430 are actuated to extend the second end 430B of each sliding jack 430 away from its first end 430A, thereby displacing upper tool frame 360, backup clamp 240, power tongs 242, and the components suspended from lifting jacks 366 (e.g., swivel 370, slip bowls 372, 376, and load cell 380) horizontally or laterally relative to lower tool frame 350 and central axis 305, as shown particularly in FIG. 9. In this manner sliding jacks 430 actuate upper tool frame 360 and the components of tool assembly 340 coupled or suspended therefrom into a horizontally or laterally offset position relative to central axis 305, where selected components of tool assembly 340 may be removed from snubbing jack 300.

Although in this embodiment each of swivel 370, slip bowls 372, 376, and load cell 380 are uncoupled from rotary drive 342 and actuated into the horizontally offset position, in other embodiments, only a subset of these components may be uncoupled from rotary drive 342 and actuated into the horizontally offset position. For instance, in another embodiment, heavy slip bowl 376 may be uncoupled from load cell 380 (e.g., via removing or releasing removable fasteners coupled therebetween, etc.) to permit the actuation of swivel 370 and slip bowls 372, 376 into the horizontally offset position while load cell 380 remains coupled to rotary drive 342 and aligned with central axis 305.

While exemplary embodiments have been shown and described, modifications thereof can be made by one of ordinary skill in the art without departing from the scope or teachings herein. The embodiments described herein are exemplary only and are not limiting. Many variations, combinations, and modifications of the systems, apparatus, and processes described herein are possible and are within the scope of the disclosure. Accordingly, the scope of protection is not limited to the embodiments described herein, but is only limited by the claims that follow, the scope of which shall include all equivalents of the subject matter of the claims. The inclusion of any particular method step or operation within the written description or a figure does not necessarily mean that the particular step or operation is necessary to the method. The steps or operations of a method listed in the specification or the claims may be performed in any feasible order, except for those particular steps or operations, if any, for which a sequence is expressly stated. In some implementations two or more of the method steps or operations may be performed in parallel, rather than serially.

What is claimed is:

1. A snubbing jack, comprising:

a jack assembly comprising a base plate, a traveling plate, an axis extending through the base plate and the traveling plate, and a plurality of piston-cylinder assemblies configured to move the traveling plate axially with respect to the base plate;

a rotary drive comprising a rotary base and a hub, wherein the rotary drive is configured to rotate the hub relative to the rotary base, and wherein the rotary base is coupled to the traveling plate to travel axially with the traveling plate;

a clamp coupled to the rotary base and configured to grip a first tubular member;

a power tongs coupled to the rotary base and configured to grip a second tubular member and to rotate the second tubular relative to the rotary base; and a torque transfer device coupled between the rotary drive and the jack assembly and configured to allow the rotary drive to move axially relative to the base plate and configured to restrict rotation of the rotary drive relative to the jack assembly.

2. The snubbing jack of claim 1, wherein the rotary base is coupled to the traveling plate by a rotary coupling configured to restrict the rotary drive from moving axially relative to the traveling plate and configured to allow rotation of the rotary drive relative to the traveling plate.

3. The snubbing jack of claim 2, wherein the rotary base comprises an annular shoulder; and wherein the rotary coupling includes an attachment member coupled to the traveling plate and having a shoulder slidingly engaging the annular shoulder of the rotary base.

4. The snubbing jack of claim 3, wherein the attachment member comprises a ring, and wherein the shoulder of the attachment member of the rotary coupling extends circumferentially around a majority of the shoulder of the rotary base.

5. The snubbing jack of claim 2, wherein the torque transfer device comprises:

a lower torque member rigidly coupled to the base plate;

an upper torque member disposed along the lower torque member and rigidly coupled to the rotary base; and a linearly sliding coupling configured to allow the upper torque member to move axially relative to the lower torque member and configured to restrict rotation of the upper torque member relative to the lower torque member.

6. The snubbing jack of claim 5, wherein the linearly sliding coupling comprises an axial slot disposed in the lower torque member and a pin extending from the upper torque member and slidingly received in the slot.

7. The snubbing jack of claim 5, wherein:

the lower torque member and the upper torque member are concentric tubular members;

the upper torque member includes a flange that is rigidly coupled to the rotary base;

the rotary base comprises an annular shoulder; and the rotary coupling comprises:

an attachment member coupled to the traveling plate and having a shoulder slidingly engaging the annular shoulder of the rotary base; and a bearing disposed between the traveling plate and the flange of the upper torque member.

8. The snubbing jack of claim 1, further comprising a mounting frame rigidly coupled to the rotary base and extending to the clamp and the power tongs;

wherein the mounting frame couples the clamp and the power tongs to the rotary base for rotational and axial support; and wherein the mounting frame is configured to allow the clamp and the power tongs to move axially relative to one another while restricting the clamp and the power tongs from rotating relative to one another.

9. The snubbing jack of claim 8, wherein the clamp and the power tongs are configured to be releasably coupled to and decoupled from the rotary base independently of each other.

10. The snubbing jack of claim 1, wherein:

the clamp is coupled to the rotary base by a first mounting frame extending between the clamp and the rotary base; and the power tongs is coupled to the rotary base by a second mounting frame extending between the power tongs and the rotary base; and the second mounting frame is independent of the first mounting frame.

11. The snubbing jack of claim 1, wherein the torque transfer device comprises a reaction member laterally offset from the axis, and wherein the reaction member is engaged by a roller coupled to the traveling plate.

12. The snubbing jack of claim 1, further comprising a tool retrieval assembly configured to move at least one of the clamp and power tongs laterally relative to the axis.

13. A snubbing jack, comprising:

a jack assembly comprising a base plate, a traveling plate, an axis extending through the base plate and the traveling plate, and a plurality of piston-cylinder assemblies configured to move the traveling plate axially with respect to the base plate;

a rotary drive comprising a rotary base and a hub, wherein the rotary drive is configured to rotate the hub relative to the rotary base, and wherein the rotary base is coupled to the traveling plate to travel axially with the traveling plate;

a clamp coupled to the rotary base and configured to grip a first tubular member;

a power tongs coupled to the rotary base and configured to grip a second tubular member and to rotate the second tubular relative to the rotary base; and a tool retrieval assembly configured to move at least one of the clamp and power tongs laterally relative to the axis.

14. The snubbing jack of claim 13, further comprising:

a first tool frame extending from the rotary drive; and a second tool frame supported by the first tool frame, wherein the second tool frame is laterally moveable relative to the first tool frame.

15. The snubbing jack of claim 14, wherein the tool retrieval assembly comprises:

a pair of arms extending laterally from the first tool frame; and a sliding jack coupled between the first tool frame and the second tool frame, wherein the sliding jack is configured to move the second tool frame laterally along a rail of each arm to dispose the second tool frame in a laterally offset position relative to the axis.

16. The snubbing jack of claim 15, wherein the tool retrieval assembly comprises a lifting jack coupled between the second tool frame and a slip bowl, wherein the lifting jack is configured to move the slip bowl axially relative to the first tool frame.

17. The snubbing jack of claim 13, further comprising a torque transfer device coupled between the rotary drive and the jack assembly and configured to allow the rotary drive to move axially relative to the base plate and configured to restrict rotation of the rotary drive relative to the jack assembly.

18. The snubbing jack of claim 17, wherein the torque transfer device comprises a pair of I-beams and wherein each I-beam is engaged by a roller coupled to the traveling plate.

19. A method for drilling a wellbore, comprising:

(a) rotating a first tubular member relative to a second tubular member with a power tong of a snubbing jack;

(b) reacting rotational torque transmitted from the power tong with a torque transfer device coupled to a jack assembly of the snubbing jack, wherein the torque transfer device comprises a telescopic torque tube through which the second tubular member extends; and (c) moving the power tong and the first tubular member each axially relative to a base plate of the jack assembly during (b).

20. The method of claim 19, further comprising:

(d) actuating a lifting jack to lift a slip bowl relative to a tool frame of the snubbing jack; and (e) actuating a sliding jack to move the slip bowl laterally relative to the tool frame.

* * * * *